US009080308B2

(12) United States Patent
Kokuryo et al.

(10) Patent No.: US 9,080,308 B2
(45) Date of Patent: Jul. 14, 2015

(54) WORK MACHINE

(71) Applicant: Hitachi Construction Machinery Co., Ltd., Bunkyo-ku, Tokyo (JP)

(72) Inventors: Osamu Kokuryo, Tsuchiura (JP); Junya Kawamoto, Tsuchiura (JP); Yasuhiro Miyahara, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 14/381,446

(22) PCT Filed: Oct. 3, 2012

(86) PCT No.: PCT/JP2012/075655

§ 371 (c)(1),
(2) Date: Aug. 27, 2014

(87) PCT Pub. No.: WO2013/128698

PCT Pub. Date: Sep. 6, 2013

(65) Prior Publication Data

US 2015/0060183 A1 Mar. 5, 2015

(30) Foreign Application Priority Data

Feb. 28, 2012 (JP) ..... 2012-041593

(51) Int. Cl.
*B60K 13/04* (2006.01)
*E02F 9/08* (2006.01)
(Continued)

(52) U.S. Cl.
CPC ..... *E02F 9/0866* (2013.01); *E02F 3/325* (2013.01); *E02F 9/18* (2013.01); *F01N 13/001* (2013.01); *F01N 13/082* (2013.01); *F01N 2590/08* (2013.01)

(58) Field of Classification Search
USPC ..... 180/89.2, 296, 309
See application file for complete search history.

(56) References Cited

U.S. PATENT DOCUMENTS 4,060,143 A * 11/1977 Matsumoto et al. ..... 180/296
2014/0106659 A1* 4/2014 Hong et al. ..... 454/162
(Continued)

FOREIGN PATENT DOCUMENTS

JP 11-256616 A 9/1999
JP 11-256617 A 9/1999
(Continued)

OTHER PUBLICATIONS

International Search Report (PCT/ISA/210) dated Jan. 8, 2013, with English translation (Five (5) pages).

*Primary Examiner* — Jeffrey J Restifo
*Assistant Examiner* — Erez Gurari
(74) *Attorney, Agent, or Firm* — Crowell & Moring LLP

(57) ABSTRACT

Provided is a working machine, which can release exhaust gas at a position above a counterweight even if no space is secured for the installation of an exhaust pipe on an upperstructure or on an upper wall of the counterweight, and which can suppress heating of the counterweight by exhaust gas. The working machine is provided with a muffler (10) into which exhaust gas is guided from an engine, and a tailpipe (11) connected to the muffler (10). Defined through a counterweight (7) is a passage (7*a*) in which the tailpipe (11) is inserted. The working machine is further provided with an exhaust pipe holding member (12) and an exhaust pipe (13). The exhaust pipe holding member (12) is attached to an outer side wall of the counterweight (7), and has a passage (12*a*) which is in communication with the passage (7*a*) of the counterweight (7) and in which the tailpipe (11) is inserted. The exhaust pipe (13) is disposed and held upright on the exhaust pipe holding member (12), and has a lower part, in which the tailpipe (11) is inserted, and an upper part defining therein an exhaust outlet (13*a*) through which the exhaust gas guided via the tailpipe (11) is released.

8 Claims, 7 Drawing Sheets

(51) Int. Cl.

| | |
|---|---|
| ***E02F 9/18*** | (2006.01) |
| ***F01N 13/00*** | (2010.01) |
| ***F01N 13/08*** | (2010.01) |
| ***E02F 3/32*** | (2006.01) |

(56) References Cited

U.S. PATENT DOCUMENTS

| | | | | |
|---|---|---|---|---|
| 2014/0124285 | A1* | 5/2014 | Kimijima et al. | 180/309 |
| 2014/0238767 | A1* | 8/2014 | Numa | 180/309 |
| 2014/0250870 | A1* | 9/2014 | Himoto et al. | 60/297 |

FOREIGN PATENT DOCUMENTS

| | | | |
|---|---|---|---|
| JP | 2000-73404 | A | 3/2000 |
| JP | 3143353 | B2 | 3/2001 |
| JP | 2002-70077 | A | 3/2002 |
| JP | 2005-335475 | A | 12/2005 |

* cited by examiner

WORK MACHINE

TECHNICAL FIELD

This invention relates to a working machine, such as a compact excavator, in which a passage with a tailpipe inserted therein is defined through a counterweight. The tailpipe is connected to a muffler into which exhaust gas from an engine is guided.

BACKGROUND ART

As a conventional technology of this type, there is one disclosed in Patent Document 1. This conventional technology has a configuration that a main muffler through which exhaust gas from an engine is guided is disposed on an upperstructure of a construction machine, an exhaust outlet portion, specifically a tailpipe is connected to the main muffler, and a passage with the tailpipe inserted therein is defined through a counterweight disposed at a lower position in a rear section of the upperstructure. Also defined in the counterweight are a cavity communicating with the above-mentioned passage and an exhaust bore for externally releasing exhaust gas guided to the cavity.

According to the conventional technology configured as described above, the exhaust gas guided from the engine via the main muffler, the tailpipe and the cavity of the counterweight is externally released from the exhaust bore of the counterweight located in the lower part of the upperstructure.

PRIOR ART DOCUMENT

Patent Document

Patent Document 1: JP-B-3143353

DISCLOSURE OF THE INVENTION

Problem to be Solved by the Invention

When the construction machine disclosed in the above-mentioned Patent Document 1 is a small machine such as a compact excavator, it is often used in relatively small working environments to perform gardening, plumbing or the like. As the exhaust bore of the counterweight is located in the lower part of the upperstructure, exhaust gas is released, in such a small working environment, toward relatively low garden plants and low structural objects existing around the construction machine, and tends to adversely affect these garden plants and structural objects. With a view to avoiding such a problem, it may be contemplated to arrange an exhaust pipe that can release exhaust gas into an upper space. Such an approach is effective when the construction machine is a large machine or the like and a space sufficient for the installation of an exhaust pipe can be secured on an upperstructure or on a top wall of a counterweight. However, small machines such as compact excavators actually include those which cannot secure a space for the installation of an exhaust pipe on an upperstructure or on a top wall of a counterweight.

In a small machine like such a compact excavator, it may be contemplated to include an exhaust pipe holding member that can be attached to an outer side wall of a counterweight and has a passage in communication with the above-mentioned passage of the counterweight, specifically the passage with the tailpipe inserted therein. In other words, it may be contemplated to have a configuration that an end portion of the tailpipe is inserted in the passage defined through the counterweight to guide exhaust gas into an exhaust pipe via the passage of the exhaust pipe holding member and the exhaust gas is released into an upper space of the counterweight from an exhaust outlet of the exhaust pipe.

When such a configuration is adopted, exhaust gas is once blown from the end portion of the tailpipe against a wall defining the passage of the counterweight, and also, against a wall defining the passage of the exhaust pipe holding member, and is then continuously guided from the passage of the counterweight into the exhaust pipe, if simply configured such that the exhaust pipe is disposed and held upright on the exhaust pipe holding member attached to the outer side wall of the counterweight and the tailpipe connected to a muffler is inserted in the passage of the counterweight. The configuration disclosed in Patent Document 1 is provided with no exhaust pipe, but is the same in this respect, that is, in the problem that the exhaust gas guided through the tailpipe is once blown against the inner wall of the counterweight.

With the conventional technology disclosed in Patent Document 1 and also with the configuration that an exhaust pipe holding member is simply arranged on an outer side wall of a counterweight as mentioned above, the counterweight is heated by exhaust gas blown against its inner wall so that a discomfort tends to be given as a result of contact to the counterweight. Especially in these days, working machines have been increasingly proposed, which are each provided between an engine and a muffler with an exhaust gas treatment device to eliminate NOx and PM (particulate matter) from exhaust gas. It is, however, known that in such a working machine, high heat is produced as a result of treatment at the exhaust gas treatment device and the temperature of exhaust gas rises, for example, to 600° C. or so although the temperature of exhaust gas was, for example, 300° C. or so in a working machine provided with no exhaust gas treatment device. The working machine provided with the exhaust gas treatment device is, therefore, accompanied by a potential problem that the counterweight may be heated to a considerable extent when it has the configuration disclosed in the above-mentioned Patent Document 1 or it has a configuration that contemplates to attach an exhaust gas holding member on an outer side wall of a counterweight as mentioned above.

With the above-mentioned actual circumstances of the conventional technology in view, the present invention has as an object thereof the provision of a working machine, which can release exhaust gas at a position above a counterweight even if no space can be secured for the installation of an exhaust pipe on an upperstructure or on an upper wall of the counterweight, and which can suppress heating of the counterweight by exhaust gas.

Means for Solving the Problem

To achieve this object, the present invention is characterized in that in a working machine provided with an upperstructure, working equipment attached to the upperstructure, an operator's seat disposed on the upperstructure, a counterweight disposed on the upperstructure at a position behind the operator's seat, a muffler disposed on the upperstructure to receive exhaust gas guided from an engine, and a tailpipe connected to the muffler, said counterweight defining therethrough a passage in which the tailpipe is inserted, the working machine is further provided with an exhaust pipe holding member attached to an outer side wall of the counterweight, and having a passage which is in communication with the passage of the counterweight and in which the tailpipe is inserted, and an exhaust pipe disposed and held upright on the exhaust pipe holding member, and having a lower part, in which the tailpipe is inserted, and an upper part defining therein an exhaust outlet through which the exhaust gas guided via the tailpipe is released.

According to the present invention configured as described above, the exhaust pipe holding member is attached to the outer side wall of the counterweight, and the exhaust pipe, which is provided in the upper part thereof with the exhaust outlet for releasing exhaust gas, is disposed and held upright on the exhaust gas holding member. Even in a working machine that cannot secure an installation space for an exhaust pipe on an upperstructure or on an upper wall of a counterweight, exhaust gas guided to the exhaust pipe from the tailpipe can, therefore, be released at a position above the counterweight.

According to the present invention, the exhaust pipe has the lower part in which the tailpipe is inserted. Therefore, the exhaust gas guided to the tailpipe from the muffler can be guided to the exhaust pipe without blowing it against a wall that defines the passage of the counterweight or against a wall that defines the passage of the exhaust gas holding member, and can be externally released from the exhaust outlet of the exhaust pipe. When the tailpipe is inserted in the passage of the counterweight, a clearance is formed between the wall of the passage of the counterweight and the tailpipe, thereby making it possible to prevent the conduction of heat from the tailpipe to the counterweight. When the tailpipe is inserted in the passage of the exhaust pipe holding member, on the other hand, a clearance is similarly formed between the wall of the passage of the exhaust pipe holding member and the tailpipe, thereby making it possible to prevent the conduction of heat from the tailpipe to the exhaust pipe holding member. Owing to these clearances, the counterweight and exhaust gas holding member are not heated directly by exhaust gas so that the heating of these counterweight and exhaust gas holding member can be suppressed.

The present invention may also be characterized in that in the above-described invention, the exhaust pipe holding member has an upper wall located at substantially the same height as an upper wall of the counterweight, and the working machine is further provided with a flange by which the exhaust pipe is attached to the upper wall of the exhaust pipe holding member. According to the present invention configured as described above, the exhaust pipe can be stably disposed and held upright on the upper wall of the exhaust pipe holding member via the flange.

The present invention may also be characterized in that in the above-described invention, the working machine is further provided with an extra counterweight disposed such that the extra counterweight outwardly protrudes from the outer side wall of the counterweight, and the exhaust pipe holding member and exhaust pipe are disposed such that as seen in a plan view, the exhaust pipe holding member and exhaust pipe do not extend outside of the extra counterweight. According to the present invention configured as described above, the exhaust pipe holding member is located within a tail swing radius, thereby making it possible to alleviate a potential problem that the exhaust pipe holding member and exhaust pipe may come into contact or interference with surrounding structural objects or the like during swinging of the upperstructure.

The present invention may also be characterized in that in the above-described invention, the working machine is further provided with plural posts disposed upright on a rear side of the operator's seat, and the exhaust pipe holding member and exhaust pipe are disposed on an imaginary line, which connects a seat reference point of the operator's seat and one of the plural posts to each other, or at a position in a neighborhood of the imaginary line.

According to the present invention configured as described above, when an operator sitting in the operator's seat is about to visually check behind the working machine, the exhaust pipe disposed and held upright by the exhaust pipe holding member is in a state that it is completely or almost completely hidden behind the post disposed upright on the rear side of the operator's seat and located on the imaginary line. The exhaust pipe can, therefore, be arranged without adversely affecting the rearward visibility of the operator sitting in the operator's seat. The exhaust pipe becomes hot when exhaust gas is guided therethrough, but the heat of radiation from a surface of the exhaust pipe is blocked by the above-mentioned post. As a consequence, the operator sitting in the operator's seat can be protected from unpleasant heating by the heat of exhaust gas.

Advantageous Effects of the Invention

According to the present invention, the exhaust pipe holding member is attached to the outer side wall of the counterweight, and the exhaust pipe is disposed and held upright on the exhaust gas holding member. Even in a working machine that cannot secure an installation space for an exhaust pipe on an upperstructure or on an upper wall of a counterweight, exhaust gas can, therefore, be externally released from the exhaust outlet of the exhaust pipe at a position above the counterweight. When the present invention is applied to a small machine, such as a compact excavator, that cannot secure a space for the installation of an exhaust pipe on an upperstructure or on an upper wall of a counterweight, exhaust gas can be prevented from being blown against relatively small plants and low structural objects existing around a work site so that these plants and structural objects can be protected from adverse effects.

According to the present invention, the exhaust gas guided to the tailpipe can be guided to the exhaust pipe without blowing it against a wall that defines the passage of the counterweight or against a wall that defines the passage of the exhaust gas holding member, and in addition, the conduction of heat from the tailpipe to the counterweight and exhaust pipe holding member can be prevented by the passage of the counterweight and the passage of the exhaust pipe holding member. As a consequence, the present invention can suppress the heating of the counterweight and exhaust pipe holding member by exhaust gas. It is, therefore, possible to avoid a discomfort which would otherwise be developed by contact to the counterweight or exhaust pipe holding member that has become hot by the heat of exhaust gas.

MODES FOR CARRYING OUT THE INVENTION

Embodiments of the working machine according to the present invention will hereinafter be described based on the drawings.

Figure 1:
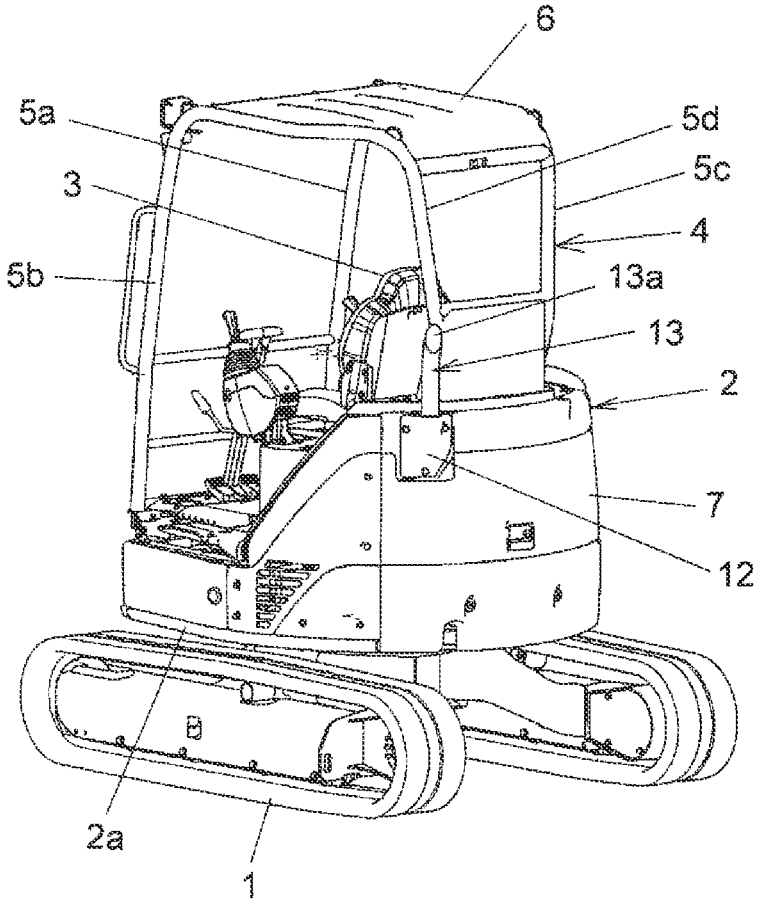
FIG. 1 is a rear three-quarter perspective view of a body of a compact excavator as a first embodiment of the working machine according to the present invention.
Figure 2:
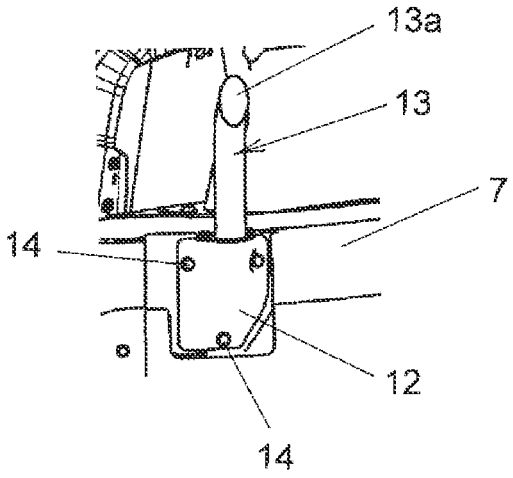
FIG. 2 is an enlarged fragmentary view of FIG.
Figure 3:
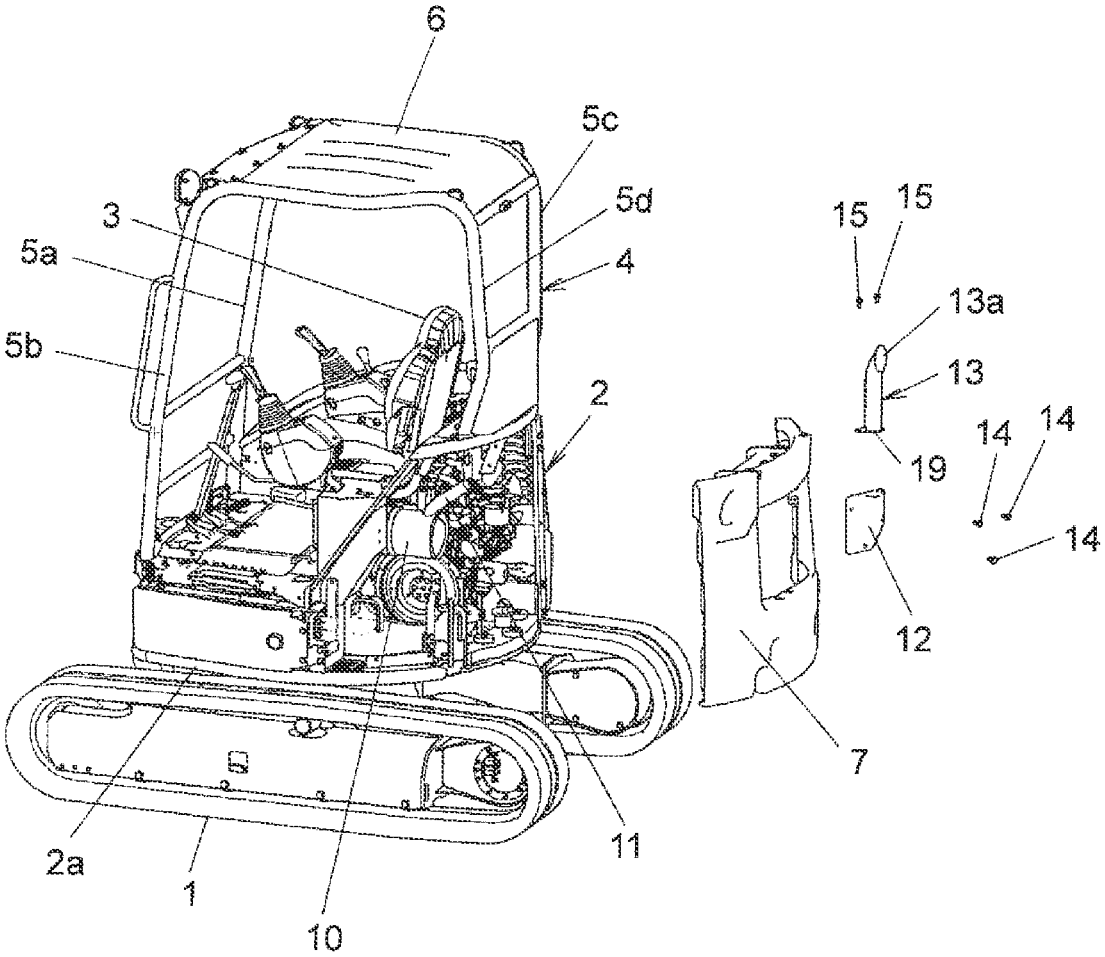
FIG. 3 is an exploded fragmentary perspective view of FIG. 1.
Figure 4:
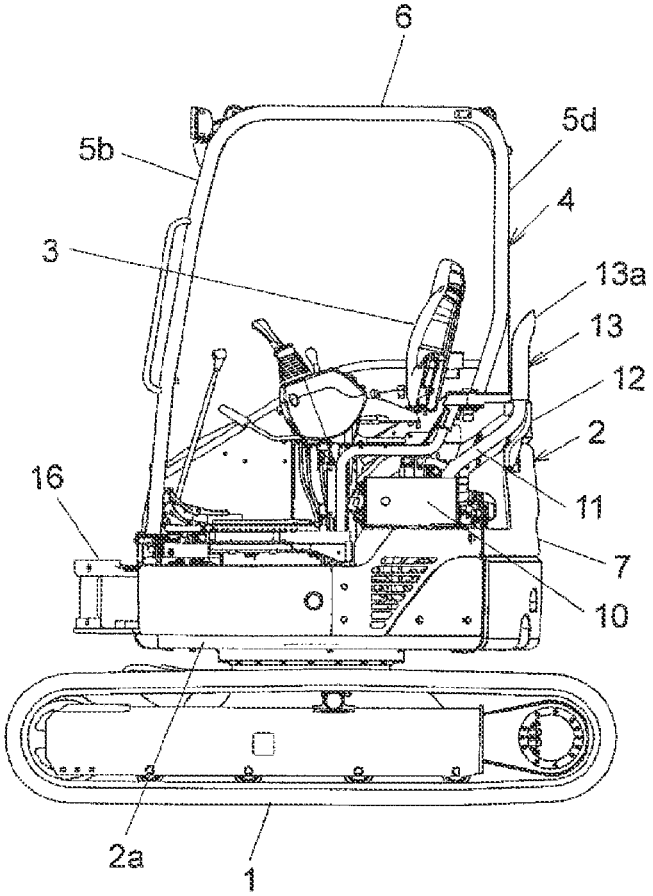
FIG. 4 is a side view of the body of the compact excavator shown in FIG. 1, with some parts being shown in cross-section.
Figure 5:
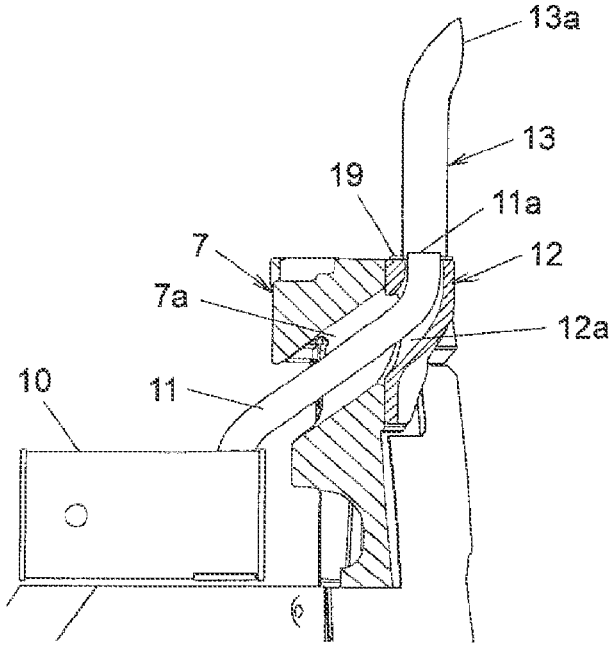
FIG. 5 is an enlarged fragmentary view of FIG. 4.
Figure 6:
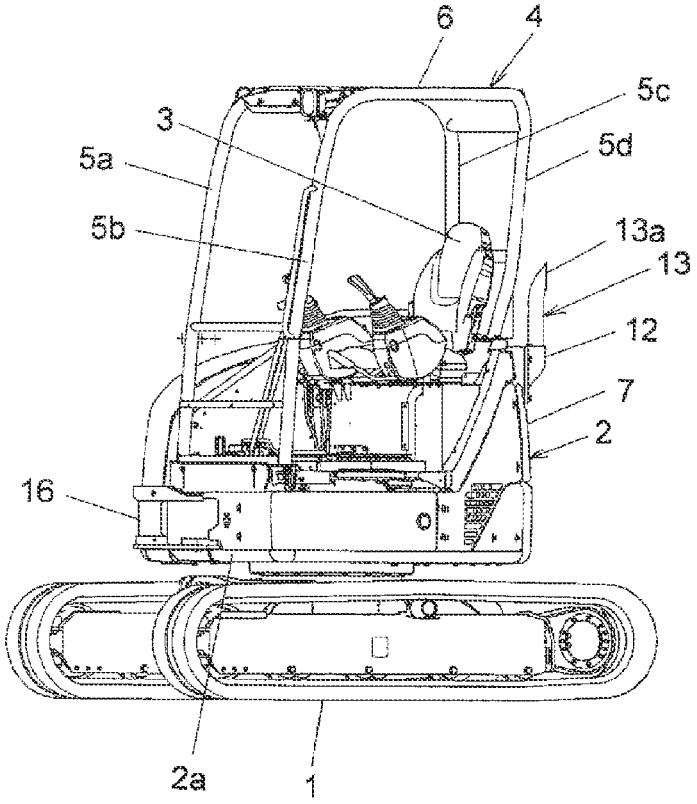
FIG. 6 is a front three-quarter perspective view of the body of the compact excavator shown in FIG. 1.
Figure 7:
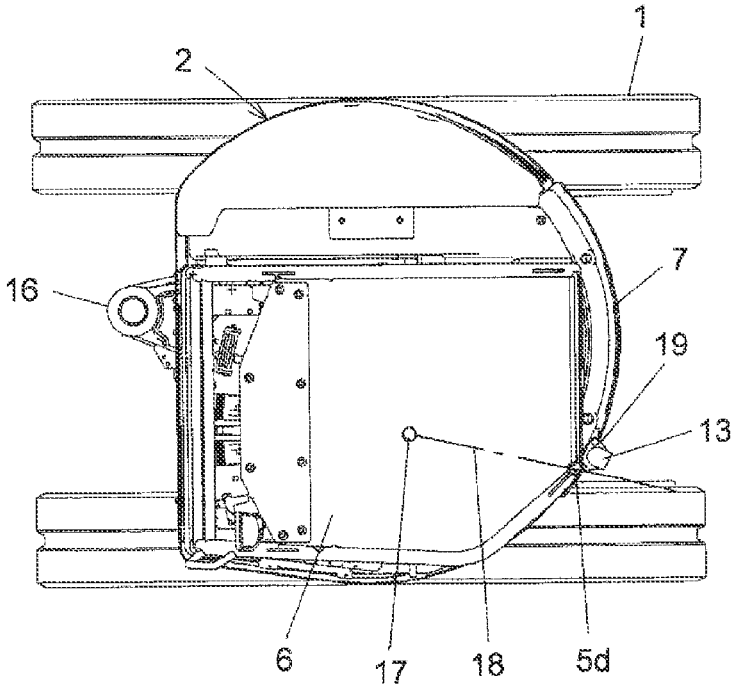
FIG. 7 is a plan view of the body of the compact excavator shown in FIG. 1.

FIG. 1 is a rear three-quarter perspective view of a body of a compact excavator as a first embodiment of the working machine according to the present invention, FIG. 2 is an enlarged fragmentary view of FIG. 1, FIG. 3 is an exploded fragmentary perspective view of FIG. 1, FIG. 4 is a side view of the body of the compact excavator shown in FIG. 1, with some parts being shown in cross-section, FIG. 5 is an enlarged fragmentary view of FIG. 4, FIG. 6 is a front three-quarter perspective view of the body of the compact excavator shown in FIG. 1, and FIG. 7 is a plan view of the body of the compact excavator shown in FIG. 1.

The compact excavator as the first embodiment is a small machine that is useful for work such as plumbing or gardening in an urban area or the like. As shown in FIGS. 1 and 4, this compact excavator is provided with a travel base 1, an upperstructure 2 disposed on the travel base 1, and unillustrated working equipment supported on a support 16 disposed at a position on a front part of the upperstructure 2. The working equipment includes a boom, arm, bucket and the like, and is configured to permit digging work or the like of earth or sand. The travel base 1 and upperstructure 2 make up a body of the compact excavator.

On a swing frame 2*a* of the upperstructure 2, an operator's seat 3 in which an operator sits is disposed, and a canopy 4 is disposed surrounding the operator's seat 3. The canopy 4 is provided, for example, with four posts, specifically a front right post 5*a*, front left post 5*b*, rear right post 5*c* and rear left post 5*d*. This canopy 4 is also provided with a roof 6, which is secured to the posts 5*a*-5*d*, and is disposed such that it covers above the operator's seat 3. At a rear position on the upperstructure 2, a counterweight 7 made, for example, of a cast material is disposed to ensure a weight balance with the unillustrated working equipment. As shown in FIGS. 2 and 3, an exhaust pipe holding member 12 is attached to an outer side wall of the counterweight 7 by bolts 14 to dispose and hold upright an exhaust pipe 13. The exhaust pipe holding member 12 is made, for example, of the same cast material as the counterweight 7.

On the swing frame 2*a* of the upperstructure 2, a muffler 10, into which exhaust gas is guided from an engine, and a tailpipe 11, which is connected to the muffler 10, are disposed as shown in FIG. 5. Through the counterweight 7, a passage 7*a* is defined with the tailpipe 11 inserted therein. A clearance is formed between the tailpipe and a wall that defines the passage 7*a* of the counterweight 7. The tailpipe 11 is, therefore, maintained out of contact with the wall of the passage 7*a* of the counterweight 7. The exhaust pipe holding member 12 has a passage 12*a*, which is in communication with the passage 7*a* of the counterweight 7 and in which the tailpipe 1 is inserted. A clearance is also formed between the tailpipe 11 and a wall that defines the passage 12*a* of the exhaust pipe holding member 12. The tailpipe 11 is, therefore, maintained out of contact with the wall of the passage 12*a* of the exhaust pipe holding member 12.

The exhaust pipe 13 includes an lower part and an upper part. In the lower part, an upper end 11*a* of the tailpipe 11 is inserted. The upper part defines therein an exhaust outlet 13*a* through which exhaust gas guided via the tailpipe 11 is released. This exhaust pipe 13 is set at such a length dimension that the distance between a ground, on which the compact excavator stands, and the exhaust outlet 13*a* becomes equal to or greater than the average height of a person, for example, equal to or greater than 170 cm.

The exhaust pipe holding member 12 has an upper wall located at the same height as an upper wall of the counterweight 7, and the exhaust pipe 13 is integrally provided at a lower end thereof with a flange 19 by which the exhaust pipe 13 is attached to the upper wall of the exhaust pipe holding member 12. The flange 19 is attached to the exhaust pipe holding member 12 by bolts 15 shown in FIG. 3. As a consequence, the exhaust pipe 13 is disposed upright and apart from the rear left post 5*d* of the canopy 4 as shown in FIG. 6.

In the compact excavator as the first embodiment, the above-mentioned exhaust pipe holding member 12 and exhaust pipe 13 are disposed, as shown in FIG. 7, at a position in a neighborhood of an imaginary line 18 which connects a seat index point (SIP) of the operator's seat 3, that is, a seat reference point 17 known as the reference point of a seating location of the operator relative to the operator's seat 3 and, for example, the rear left post 5*d* to each other.

In this first embodiment, exhaust gas is guided from the engine into the muffler 10 to perform sound deadening. The exhaust gas discharged from the muffler 10 is guided into the tailpipe 11, is then guided from the upper end 11*a* of the tailpipe 11 into the exhaust pipe 13, and is externally released from the exhaust outlet 13*a* of the exhaust pipe 13 at a position above the counterweight 7.

In the first embodiment configured as described above, the exhaust pipe holding member 12 is attached to the outer side wall of the counterweight 7, and the exhaust pipe 13, which is provided in the upper part thereof with the exhaust outlet 13*a* for releasing exhaust gas, is disposed and held upright on the exhaust gas holding member 12. Even if the compact excavator cannot secure an installation space for the exhaust pipe 13 on the upperstructure 2 or on the upper wall of the counterweight 7, exhaust gas can, therefore, be externally released at the position above the counterweight 7 owing to the upright disposition and holding of the exhaust pipe 13. As a consequence, exhaust gas can be prevented from being blown against relatively small plants and low structural objects existing around a work site of the compact excavator so that these garden plants and structural objects can be protected from adverse effects.

As the exhaust pipe 13 has the lower part with the tailpipe 11 inserted therein, the exhaust gas guided from the muffler 10 to the tailpipe 11 can be guided to the exhaust pipe 13 without blowing it against the wall that defines the passage 7*a* of the counterweight 7 or against the wall that defines the passage 12*a* of the exhaust gas holding member 12, and can then be externally released from the exhaust outlet 13*a* of the exhaust pipe 13. Further, between the tail pipe 11 and the wall that defines the passage 7*a* of the counterweight 7, the clearance is provided to prevent the conduction of heat from the tailpipe 11 to the counterweight 7, and between the tail pipe 11 and the wall that defines the passage 12*a* of the exhaust pipe holding member 12, the clearance is provided to prevent the conduction of heat from the tailpipe 11 to the exhaust pipe holding member 12. Owing to these clearances, the counterweight 7 and exhaust pipe holding member 12 are not heated directly, thereby making it possible to suppress the heating of the counterweight 7 and exhaust pipe holding member 12 by exhaust gas. It is, therefore, possible to avoid a discomfort which would otherwise be developed by contact to the counterweight 7 or exhaust pipe holding member 12 that has become hot by the heat of exhaust gas.

This first embodiment is also provided with the flange 19 by which the exhaust pipe 13 is attached to the upper wall of the exhaust pipe holding member 12. The exhaust pipe 13 can, therefore, be stably disposed and held upright on the upper wall of the exhaust pipe holding member 12 via the flange 19.

In the first embodiment, the exhaust pipe holding member 12 and exhaust pipe 13 are disposed at the position in the neighborhood of the imaginary line 18 which connects the seat reference point 17 of the operator's seat 3 and the rear left post 5*d* to each other. When the operator sitting in the operator's seat 3 is about to visually check behind the compact excavator, the exhaust pipe 13 is, therefore, in a state that it is hidden behind the rear left post 5*d*. The exhaust pipe 13 can hence be arranged without adversely affecting the rearward visibility of the operator sitting in the operator's seat 3. The exhaust pipe 13 becomes hot when exhaust gas is guided therethrough. The operator sitting in the operator's seat 3 can, however, be protected from unpleasant heating by the heat of exhaust gas, because the exhaust pipe 13 is disposed upright and apart from the rear left post 5*d* of the canopy 4 and the heat of radiation from the surface of the exhaust pipe 13 is blocked by the post 5*d*.

Figure 8:
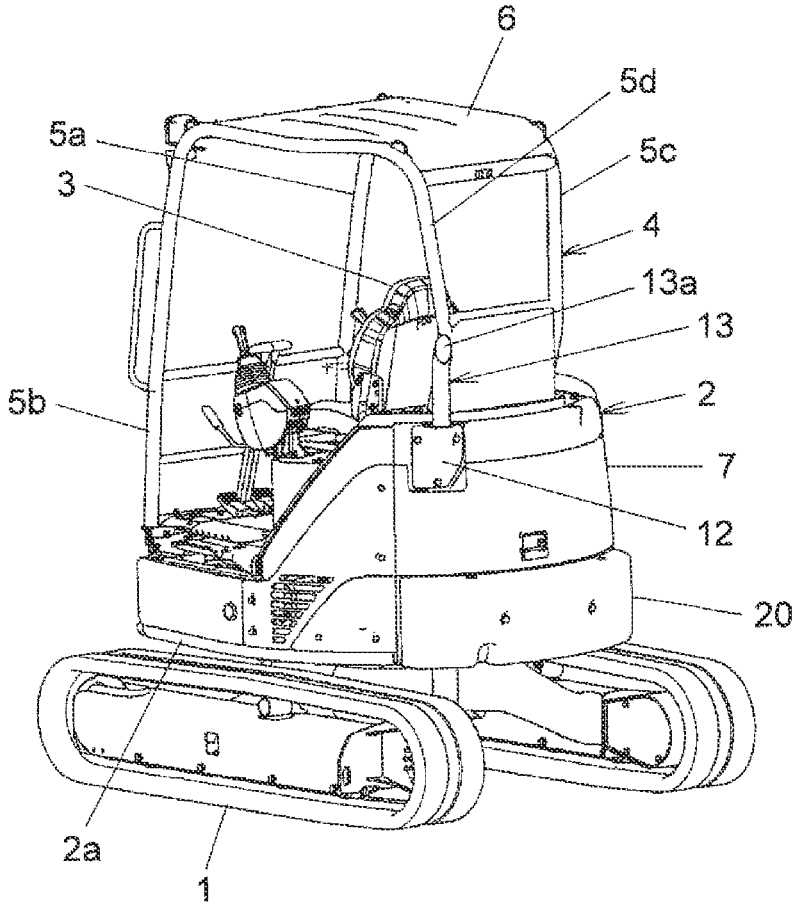
FIG. 8 is a rear three-quarter perspective view of a body of a compact excavator as a second embodiment of the working machine according to the present invention.
Figure 9:
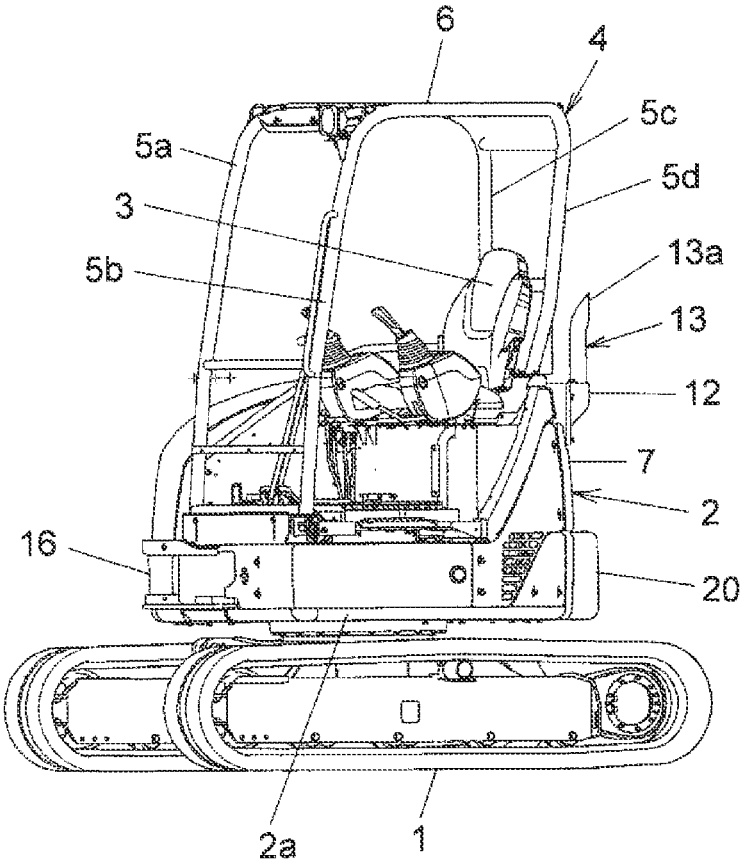
FIG. 9 is a front three-quarter perspective view of the body of the compact excavator shown in FIG. 8.
Figure 10:
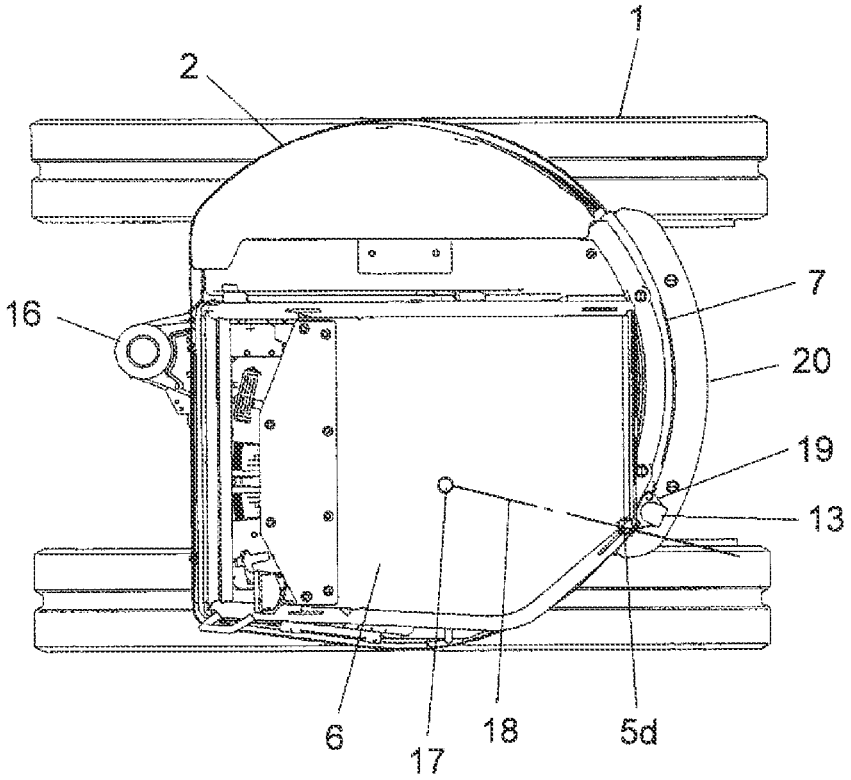
FIG. 10 is a plan view of the body of the compact excavator shown in FIG. 8.

FIG. 8 is a rear three-quarter perspective view of a body of a compact excavator as a second embodiment of the working machine according to the present invention, FIG. 9 is a front three-quarter perspective view of the body of the compact excavator shown in FIG. 8, and FIG. 10 is a plan view of the body of the compact excavator shown in FIG. 8.

To ensure a more stable weight balance, the compact excavator shown as the second embodiment in these FIGS. 8 to 10 is provided with an extra counterweight 20 disposed such that it protrudes from the outer side wall of the counterweight 7. The exhaust pipe holding member 12 and exhaust pipe 13 are disposed such that as seen in a plan view, they do not extend outside of the extra counterweight 20. The remaining configuration is similar to that of the above-mentioned first embodiment.

The second embodiment configured as described above can bring about similar advantageous effects as the first embodiment. In addition, the exhaust pipe holding member 12 and exhaust pipe 13 are located within a tail swing radius, thereby making it possible to alleviate a potential problem that the exhaust pipe holding member 12 and exhaust pipe 13 may come into contact or interference with surrounding structural objects or the like during swinging of the upperstructure 2. Owing to this feature, it is possible to protect the exhaust pipe holding member 12 and exhaust pipe 13 from damage which would otherwise be associated with the swinging of the upperstructure 2.

It is to be noted that in the above-described first and second embodiments, the exhaust pipe holding member 12 and exhaust pipe 13 are disposed at the position in the neighborhood of the imaginary line 18 connecting the seat reference point 17 of the operator's seat 3 and the rear left post 5*d* to each other but these exhaust pipe holding member 12 and exhaust pipe 13 may be disposed on the imaginary line 18.

It is also to be noted that in the above-described first and second embodiments, the exhaust pipe holding member 12 and exhaust pipe 13 are disposed at the position in the neighborhood of the rear left post 5*d* but these exhaust pipe holding member 12 and exhaust pipe 13 may be disposed on an imaginary line connecting the seat reference point 17 of the operator's seat 3 and the rear right post 5*c* to each other or at a position in a neighborhood of the imaginary line.

Although the above-described first and second embodiments are each provided with the 4-post canopy, the present invention can also be applied to a compact excavator provided with a 2-post canopy. The present invention can also be applied to a working machine, such as a compact excavator, which is provided with an operator's cab instead of such a canopy. When the present invention is applied to a working machine, such as a compact excavator, which is provided with an operator's cab, the working machine has a configuration that an exhaust pipe holding member and an exhaust pipe are disposed on an imaginary line, which connects a cab-forming rear pillar and an operator's seat to each other, or at a position in a neighborhood of the imaginary line.

In the above-described first and second embodiments, the exhaust pipe 13 is disposed and held upright on the exhaust pipe holding member 12 such that the exhaust outlet 13*a* is directed rearward. However, the present invention is not limited to such a configuration, and the exhaust pipe 13 may be disposed and held upright on the exhaust pipe holding member 12 such that the exhaust outlet 13*a* is directed laterally or obliquely rearward.

In the above-described first and second embodiments, the exhaust pipe 13 is exposed to an outside. However, an exhaust pipe cover may be arranged to cover around and above the exhaust pipe 13 instead of exposing the exhaust pipe 13.

In the above-described first and second embodiments, the exhaust pipe 13 is attached to the upper wall of the exhaust pipe holding member 12 via the flange 19. However, the exhaust pipe 13 and flange 19 may be integrally formed upon fabrication of the exhaust pipe 13, or the exhaust pipe 13 and flange 19 may be fabricated as discrete members and may then be connected together by welding.

The working machines according to the above-described first and second embodiments are the compact excavators, respectively. The present invention is, however, not limited to compact excavators. The present invention can also be applied to working machines of larger models than compact excavators, such as hydraulic excavators.

LEGEND

2 Upperstructure
3 Operator's seat
4 Canopy
5*d* Rear left post
6 Roof
7 Counterweight
7*a* Passage
10 Muffler
11 Tailpipe
12 Exhaust pipe holding member
12*a* Passage
13 Exhaust pipe
13*a* Exhaust outlet
16 Support
17 Seat reference point
18 Imaginary line
19 Flange
20 Extra counterweight

The invention claimed is:

1. A working machine provided with an upperstructure, working equipment attached to the upperstructure, an operator's seat disposed on the upperstructure, a counterweight disposed on the upperstructure at a position behind the operator's seat, a muffler disposed on the upperstructure to receive exhaust gas guided from an engine, and a tailpipe connected to the muffler, said counterweight defining therethrough a passage in which the tailpipe is inserted, wherein the working machine is further provided with:

an exhaust pipe holding member attached to an outer side wall of the counterweight, and having a passage which is in communication with the passage of the counterweight and in which the tailpipe is inserted, and an exhaust pipe disposed and held upright on the exhaust pipe holding member, and having a lower part, in which the tailpipe is inserted, and an upper part defining therein an exhaust outlet through which the exhaust gas guided via the tailpipe is released.

2. The working machine according to claim 1, wherein:

the exhaust pipe holding member has an upper wall located at substantially the same height as an upper wall of the counterweight, and the working machine is further provided with a flange by which the exhaust pipe is attached to the upper wall of the exhaust pipe holding member.

3. The working machine according to claim 1, wherein:

the working machine is further provided with an extra counterweight disposed such that the extra counterweight outwardly protrudes from the outer side wall of the counterweight, and the exhaust pipe holding member and exhaust pipe are disposed such that as seen in a plan view, the exhaust pipe holding member and exhaust pipe do not extend outside of the extra counterweight.

4. The working machine according to claim 1, wherein:

the working machine is further provided with plural posts disposed upright on a rear side of the operator's seat, and the exhaust pipe holding member and exhaust pipe are disposed on an imaginary line, which connects a seat reference point of the operator's seat and one of the plural posts to each other, or at a position in a neighborhood of the imaginary line.

5. The working machine according to claim 2, wherein:

the working machine is further provided with an extra counterweight disposed such that the extra counterweight outwardly protrudes from the outer side wall of the counterweight, and the exhaust pipe holding member and exhaust pipe are disposed such that as seen in a plan view, the exhaust pipe holding member and exhaust pipe do not extend outside of the extra counterweight.

6. The working machine according to claim 2, wherein:

the working machine is further provided with plural posts disposed upright on a rear side of the operator's seat, and the exhaust pipe holding member and exhaust pipe are disposed on an imaginary line, which connects a seat reference point of the operator's seat and one of the plural posts to each other, or at a position in a neighborhood of the imaginary line.

7. The working machine according to claim 3, wherein:

the working machine is further provided with plural posts disposed upright on a rear side of the operator's seat, and the exhaust pipe holding member and exhaust pipe are disposed on an imaginary line, which connects a seat reference point of the operator's seat and one of the plural posts to each other, or at a position in a neighborhood of the imaginary line.

8. The working machine according to claim 4, wherein:

the working machine is further provided with plural posts disposed upright on a rear side of the operator's seat, and the exhaust pipe holding member and exhaust pipe are disposed on an imaginary line, which connects a seat reference point of the operator's seat and one of the plural posts to each other, or at a position in a neighborhood of the imaginary line.

* * * * *